United States Patent [19]

Garabedian

[11] Patent Number: 4,615,276

[45] Date of Patent: Oct. 7, 1986

[54] SHELF DIVIDER ASSEMBLY

[76] Inventor: Aram G. Garabedian, 173 Belvedere Dr., Cranston, R.I. 02920

[21] Appl. No.: 776,492

[22] Filed: Sep. 16, 1985

[51] Int. Cl.[4] ..... A47B 57/00; A47F 5/00

[52] U.S. Cl. ..... 108/61; 312/234.4; 312/140.4; 211/184

[58] Field of Search ..... 108/61, 27, 902, 60; 211/184; 312/140.1, 140.4, 140.3, 234.4, 234, 234.1, 234.2, 234.3, 234.5

[56] References Cited

U.S. PATENT DOCUMENTS

| | | | |
|---|---|---|---|
| 1,736,574 | 11/1929 | Binks | 312/234.4 X |
| 2,516,122 | 7/1950 | Hughes | 211/184 |
| 2,884,139 | 4/1959 | Dunham | 211/184 |
| 3,073,661 | 1/1963 | Kelling | 312/234.4 X |
| 3,308,964 | 3/1967 | Pistone | 211/184 |
| 3,512,652 | 5/1970 | Armstrong | 312/140.3 X |
| 3,612,292 | 10/1971 | Nervig | 211/184 |
| 4,208,818 | 6/1980 | Butcher | 211/184 X |
| 4,488,653 | 12/1984 | Belokin | 211/184 |

FOREIGN PATENT DOCUMENTS

| | | | |
|---|---|---|---|
| 1167308 | 4/1964 | Fed. Rep. of Germany | 312/234.4 |
| 465172 | 12/1968 | Switzerland | 312/140.4 |

*Primary Examiner*—William E. Lyddane
*Assistant Examiner*—Jose V. Chen
*Attorney, Agent, or Firm*—Salter & Michaelson

[57] ABSTRACT

A shelf divider assembly is disclosed and comprises a bracket which is securable on the forward edge portion of a shelf, an elongated shelf divider element, and a foot element which is attached to an end of the shelf divider element and is snap receivable in a rearwardly facing channel in the bracket for securing the shelf divider element to the bracket. The assembly is constructed so that when the bracket is secured to the forward edge portion of a shelf, the shelf divider element extends rearwardly across the shelf for dividing it into a plurality of discrete shelf sections and the foot element is longitudinally repositionable in the channel in the bracket for adjusting the position of the shelf divider element on the shelf.

4 Claims, 4 Drawing Figures

SHELF DIVIDER ASSEMBLY

BACKGROUND OF THE INVENTION

The instant invention relates to shelves of the type which are used for storing and/or displaying various types of articles and more particularly to a shelf divider assembly which is securable on a shelf for dividing it into a plurality of discrete shelf sections.

In many instances, due to space limitations, it is necessary to store and/or display several different articles or different types of articles on a single shelf. For example, in retail stores, particularly drug stores, it is frequently necessary to display large numbers of different types of articles on common shelves. However, while this practice can be effectively utilized for storing and/or displaying articles which are relatively dissimilar in appearance, it can lead to confusion when it is utilized for storing and/or displaying articles which are similar in appearance unless partitions are provided between the different types of articles on each shelf. For instance, when articles which are marketed in standardized containers, such as various different types of vitamin tablets, are displayed on a common shelf without providing partitions therebetween, confusion can easily result, particularly if the containers containing different types of tablets have become intermixed. Accordingly, when items, such as containers of vitamin tablets are displayed in this manner, it is easy for customers to inadvertently select containers containing incorrect products and similarly it is easy for retailers to miscalculate inventories etc.

In order to overcome the problem of segregating various types of products which are displayed and/or stored on common shelves, a variety of different types of shelf divider systems have been developed. In this regard, various heretofore known shelf divider systems which represent the closest prior art to the instant invention of which the applicant is aware are disclosed in the U.S. patents to HUGHES U.S. Pat. No. 2,516,122; JUNKIN U.S. Pat. No. 2,588,635; ESHLIN U.S. Pat. No. 2,688,409; DUNHAM U.S. Pat. No. 2,884,139; PROPST U.S. Pat. No. 3,285,429; ELKINS U.S. Pat. No. 3,780.876; and BUTCHER U.S. Pat. No. 4,208,818. However, while these references disclose a variety of different shelf divider apparatus, they fail to disclose or suggest a shelf divider system which embodies the structural features of the shelf divider assembly of the instant invention and hence, they are believed to be of only general interest.

The instant invention provides an effective shelf divider assembly which is operative for adjustably separating a shelf into a plurality of discrete shelf sections in order to segregate articles displayed an/or stored thereon. In this regard, the shelf divider assembly of the instant invention comprises an elongated bracket having a longitudinally extending rearwardly facing channel formed therein, a shelf divider element, and a foot element which is attached to the shelf divider element and adjustably receivable in engagement in the channel in the bracket for securing the shelf divider element to the bracket. The bracket is constructed so that it is securable to the forward edge portion of a shelf in longitudinally extending relation therewith, so that identifying tags, labels, etc., can be secured to the front surface thereof, and so that the channel in the bracket faces rearwardly across the upper surface of the shelf, and the shelf divider element is constructed so that it is receivable on the upper surface of the shelf behind the bracket. The foot element is constructed so that it is receivable in the rearwardly facing channel in the bracket for adjustably securing the shelf divider element to the bracket so that when the bracket is secured to the forward edge portion of a shelf, the shelf divider element extends substantially rearwardly therefrom along the upper surface of the shelf for dividing it into a plurality of discrete shelf sections. The bracket is preferably constructed so that it has a pair of elongated longitudinally extending upper and lower opposed jaws thereon which define a reduced mouth of the channel and the foot element preferably comprises a body portion and a locking portion, and it is receivable in a locked position in the channel, wherein the body portion is disposed within the channel and the locking portion is disposed on the exterior channel and engages the bracket adjacent the mouth of the channel for retaining the body portion in the locked position. Further, the foot element is preferably formed so that when it is in the lcoked position, the body portion is received in a wedged relation in the channel wherein it extends diagonally upwardly and forwardly from the lower jaw of the bracket to the top wall of the channel and the locking portion preferably comprises a stop member which engages the bracket adjacent the upper jaw when the foot element is in the locked position so that it prevents the shelf divider element from being pivoted upwardly when the bracket is secured on a shelf. Still further, the foot element is preferably formed so that it has an elongated slot therein which is positioned so that when the foot element is in the locked position thereof, the lower jaw of the bracket is received in the slot in order to further prevent thhe foot element from being pivoted upwardly.

Accordingly, it is a primary object of the instant invention to provide a shelf divider assembly comprising an elongated bracket which is securable on the forward edge portion of a shelf and a shelf divider element which is securable to the bracket so that when the bracket is mounted on the forward edge portion of the shelf, the shelf divider element extends rearwardly therefrom across the upper surface of the shelf.

Another object of the instant invention is to provide an effective and versatile shelf divider assembly comprising an elongated bracket and a shelf divider element which is detachably secured to the bracket and which is longitudinally repositionable with respect thereto.

A still further object of the instant invention is to provide an effective apparatus for segregating different types of articles on a shelf.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
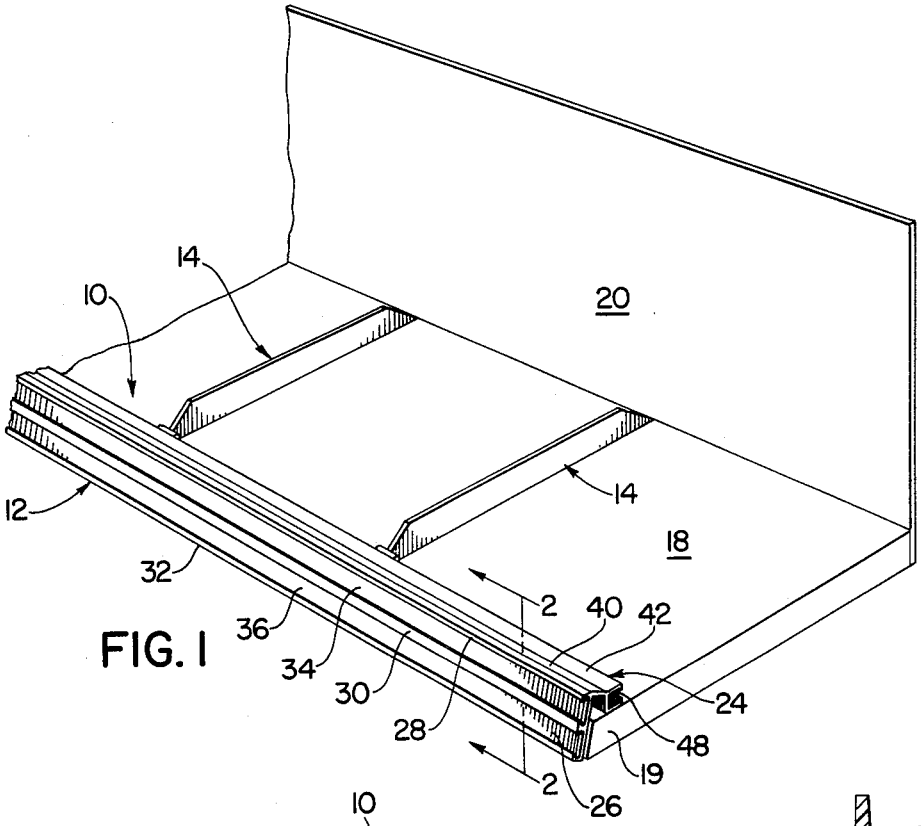
FIG. 1 is a perspective view of the shelf divider assembly of the instant invention received on a shelf.
Figure 2:
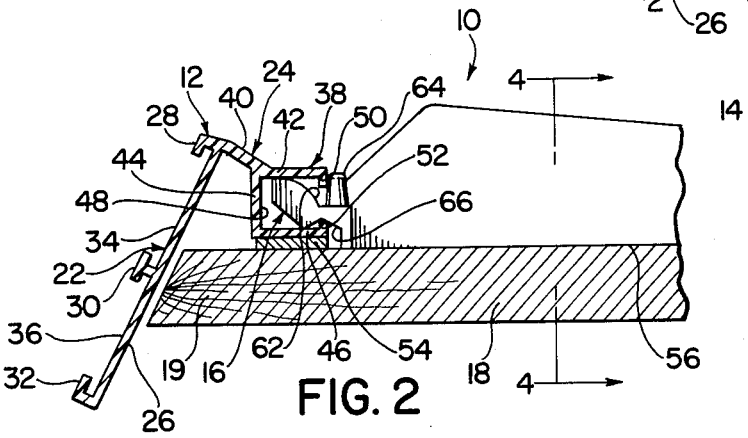
FIG. 2 is a fragmentary sectional view taken along line 2—2 and FIG. 1.
Figure 4:
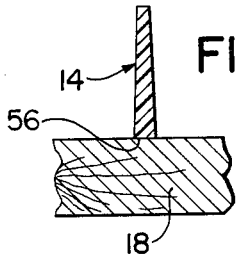
FIG. 4 is a sectional view taken along line 4—4 in FIG. 2.
Figure 3:
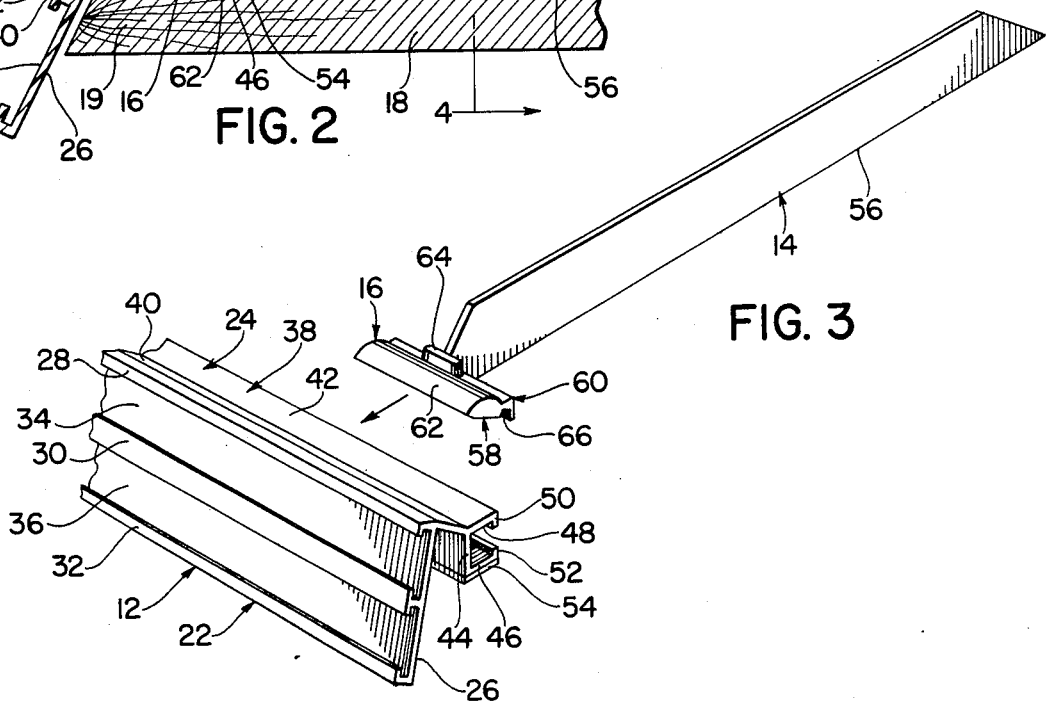
FIG. 3 is an exploded perspective view of the assembly.

Referring now to the drawing, the shelf divider assembly of the instant invention is illustrated and generally indicated at 10 in FIGS. 1-3. As will be seen, the shelf divider assembly 10 comprises an elongated bracket generally indicated at 12, a shelf divider element generally indicated at 14, and a foot element generally indicated at 16 which is attached to the shelf divider element 14 and receivable in engagement in the bracket 12 for detachable securing the shelf divider element 14 thereto. As will be seen from FIG. 1, the shelf divider assembly 10 preferably comprises a plurality of the shelf divider elements 14, and it is securable on a shelf 18 so that the shelf divider elements 14 extend substantially rearwardly across the upper surface of the shelf 18 to divide it into a plurality of discrete shelf sections.

The bracket 12 is preferably made of a suitable rigid plastic material in an elongated configuration and it preferably comprises an elongated forward portion generally indicated at 22, and an elongated rear channel portion generally indicated at 24. The forward portion 22 comprises an elongated, longitudinally extending, substantially flat main wall 26 and elongated, spaced, longitudinally extending upper, intermediate and lower track elements 28, 30, and 32, respectively which are integrally formed on the front side of the main wall 26. In this regard, the track elements 28, 30, and 32 are oriented so that they define a pair of upper and lower forwardly facing display tracks 34 and 36, respectively, on the front side of the main wall 26 for receiving and containing identifying tags, labels, etc. on the bracket 12. The channel portion 24 comprises an elongated longitudinally extending channel member generally indicated at 38 and an elongated connector wall 40 which integrally connects the main wall 26 to the channel member 38. The channel member 38 preferably comprises integrally connected top, front, and bottom wall portions, 42, 44, and 46, respectively which cooperate to define a rearwardly facing channel 48 of substantially rectangular section and it further comprises a pair of upper and lower jaw elements 50 and 52 which are integrally formed with the top and bottom walls 42 and 46, respectively, for defining a reduced mouth or opening of the channel 48. Attached to the outer surface of the bottom wall 46 of the channel member 38 is an adhesive strip 54 which is adjustably securable to the upper surface of a shelf, such as the shelf 18, for securing the bracket 12 thereto adjacent the forward edge portion 19 in the manner illustrated in FIG. 1. As will be seen, when the bracket 12 is secured to the shelf 18 in this manner, the forward portion 22 extends downwardly and outwardly along the forward edge portion 19, whereas the channel 48 faces rearwardly across the upper surface of the shelf 18.

The shelf divider element 14 is preferably made of a suitable rigid plastic material and it comprises an elongated substantially flat member having a longitudinally extending, substantially straight bottom edge 56. The shelf divider element 14 is preferably formed so that it is receivable on the shelf 18 so that the bottom edge 56 rests on the upper surface thereof and so that the shelf divider element 14 extends substantially rearwardly on the shelf 18 as illustrated.

The foot element 16 is most clearly illustrated in FIGS. 2 and 3 and it is preferably integrally formed with the shelf divider element 14 from a suitable plastic material. The foot element 16 comprises a body portion generally indicated at 58 and a locking portion generally indicated at 60 and it is dimensioned and configured so that it is snap receivable in the channel 48 for detachably securing the shelf divider element 14 to the bracket 12. In this regard, the foot element 16 is preferably formed with an extended width as illustrated, and it is preferably secured to the shelf divider element 14 so that it extends forwardly therefrom and so that when the foot element 16 is received in the channel 48, the shelf divider element 14 extends rearwardly in substantially, perpendicular relation from the bracket 12. The body portion 58 is preferably formed with an upper surface 62 thereon which extends arcuately forwardly relative to the shelf divider element 14 and the locking portion 60 preferably includes a stop member 64 on the upper side thereof which is disposed in substantially perpendicular relation to the shelf divider element 14. The body portion 58 and the locking portion 60 are further formed so that they cooperate to define an elongated slot 66 on the underside of the foot element 16 which is also disposed in substantially perpendicular relation with respect to the shelf divider element 14. The foot element 16 is preferably dimensioned and configured so that when the body portion 58 is received in the channel 48 and the lower jaw 52 is received in the slot 66, the body portion 58 extends diagonally upwardly and forwardly in the channel 48 and the arcuate upper surface 62 of the body portion 58 engages the upper wall 42 to wedge the body portion 58 in the channel 48 between the upper wall 42 and the lower jaw 52. The foot portion 16 is further preferably formed so that when the body portion 58 is received in the channel 48 in this manner, the stop member 64 engages the upper jaw 50 to prevent the shelf divider element 14 from being pivoted upwardly. Further, the foot portion 16 is preferably attached to the shelf divider element 14 so that when it is received in the channel 48 in the locked position as illustrated in FIG. 2 and the bracket is secured to the forward edge portion 19, the lower edge 56 of the shelf divider element 14 rests on the upper surface of the shelf 18.

For use and operation of the shelf divider assembly 10, the bracket 12 is secured to the upper surface of the shelf 18 with the downwardly facing adhesive strip 54 so that the bracket 12 extends along the forward edge of the shelf 18, and the foot element 16 is assembled with the bracket 12 to secure the shelf divider element 14 thereto. In this regard, the foot element 16 is preferably assembled with the bracket 12 by inserting the body portion 58 of the foot element 16 between the jaws 50 and 52 and then tilting the shelf divider element 14 downwardly until the foot element 16 is snap received in the locked position in the channel 48 and the lower edge 56 of the shelf divider element 14 engages the upper surface of the shelf 18. When the foot element 16 is assembled with the bracket in this manner, the stop member 64 engages the upper jaw 50 to prevent the shelf divider element 14 from being pivoted upwardly from the shelf 18. Further, because of the manner in which the foot element 16 is received in the channel 48, the body portion 58 frictionally engages the upper and lower walls 42 and 46, respectively, to longitudinally retain the foot element 16 in the desired position in the channel 48, although the shelf divider element 14 is nevertheless repositionable with respect to the bracket 12 by manually sliding the foot element 16 in the channel 48. Further, because of the way in which the foot element 16 is snap received in the channel 48, it is also detachable therefrom when desired.

It is seen therefore that the instant invention provides an effective shelf divider system for segregating different types of articles on a shelf. Identifying labels, price tags, etc., can be effetively assembled in the tracks 34 and 36 of the bracket 12 so that they are displayed in front of the sehlf 18, and the bracket 12 can be easily installed on the forward edge portion 19 of the shelf 18 with the adhesive strip 54. The shelf divider elements 14 can be detachably secured to the bracket 12 with the foot elements 16 at various positions in the longitudinal extent of the bracket for effectively dividing the shelf 18 into a plurality of discrete shelf sections. Further, the foot elements 16 can easily be longitudinally repositioned in the channel 48 for longitudinally repositioning the shelf divider elements 14 at different locations on the shelf 18. Accordingly, it is seen that the instant invention provides a shelf divider assembly which is both simple and highly effective and that as a result, the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A shelf divider assembly comprising:

a. an elongated bracket having a longitudinally extending channel formed therein, said bracket having elongated longitudinally extending upper and lower jaws thereon defining a reduced mouth of said channel, said bracket being securable to the forward edge portion of a shelf so that it extends longitudinally therealong and so that said channel faces rearwardly across the upper surface of said shelf;

b. a shelf divider element receivable on the upper surface of said shelf; and c. a foot element attached to said shelf divider element and detachably receivable in engagement in said channel for securing said shelf divider element to said bracket so that when said bracket is secured to said shelf forward edge portion, said shelf divider element extends a distance substantially rearwardly across the upper surface of said shelf, said foot element comprising a body portion extending diagonally forwardly and upwardly from said shelf divider element and a stop element on the upper side of said foot element adjacent said shelf divider element, said body portion having a slot formed therein on the lower side thereof adjacent said shelf divider element and substantially opposite from said stop element, said slot extending across said body portion in a direction substantially perpendicular to said shelf divider element, said foot element being receivable in a locked position in said channel wherein said lower jaw is received in said slot and said body portion extends diagonally forwardly and upwardly in said channel and engages the upper wall thereof, said foot element being receivable in said locked position by passing said body portion forwardly between said jaws until said stop element engages said bracket adjacent said upper jaw and then pivoting said shelf divider element downwardly while maintaining said stop element in engagement with said bracket until said lower jaw is received in said slot.

2. In the shelf divider assembly of claim 1, said foot element being snap receivable in said locked position.

3. The shelf divider assembly of claim 1 further comprising means for detachably receiving a plurality of labels on said bracket so that said labels face outwardly from said shelf for displaying said labels when said bracket is secured to said shelf.

4. In the shelf divider assembly of claim 3, said means for receiving labels further characterized as comprising a pair of spaced track elements on said bracket which cooperate to define a track thereon for receiving said labels.

* * * * *